US009180335B1

(12) United States Patent
Wu

(10) Patent No.: US 9,180,335 B1
(45) Date of Patent: Nov. 10, 2015

(54) EXERCISE WHEEL

(71) Applicant: Yung-Cheng Wu, Tainan (TW)

(72) Inventor: Yung-Cheng Wu, Tainan (TW)

( * ) Notice: Subject to any disclaimer, the term of this patent is extended or adjusted under 35 U.S.C. 154(b) by 15 days.

(21) Appl. No.: 14/295,393

(22) Filed: Jun. 4, 2014

(51) Int. Cl.

| | |
|---|---|
| ***A63B 22/20*** | (2006.01) |
| ***A63B 21/00*** | (2006.01) |
| ***A63B 23/02*** | (2006.01) |
| ***A63B 23/12*** | (2006.01) |

(52) U.S. Cl.
CPC ..... *A63B 22/20* (2013.01); *A63B 21/1469* (2013.01); *A63B 21/1484* (2013.01); *A63B 23/02* (2013.01); *A63B 23/0205* (2013.01); *A63B 23/1272* (2013.01)

(58) Field of Classification Search
CPC ..... A63B 21/00003; A63B 21/0004; A63B 21/00094; A63B 21/00101; A63B 21/00109; A63B 21/00116; A63B 21/0012; A63B 21/00123; A63B 21/00127; A63B 21/0013; A63B 21/00185; A63B 21/002; A63B 21/012; A63B 21/0125; A63B 21/015; A63B 21/06; A63B 21/0618; A63B 21/068; A63B 21/072; A63B 21/0724; A63B 21/0726; A63B 21/1446; A63B 21/1465; A63B 21/1469; A63B 21/1476; A63B 21/148; A63B 21/1484; A63B 21/1488; A63B 21/1492; A63B 21/1496; A63B 21/15; A63B 21/22; A63B 21/225; A63B 21/227; A63B 2021/222; A63B 22/0002; A63B 22/001; A63B 22/0012; A63B 22/0015; A63B 22/20; A63B 22/201; A63B 22/203; A63B 22/208; A63B 2022/0005; A63B 2022/0017; A63B 2022/0028; A63B 2022/003; A63B 2022/0033; A63B 2022/0035; A63B 2022/0041; A63B 2022/206; A63B 23/02; A63B 23/0205; A63B 23/0211; A63B 23/0216; A63B 23/0222; A63B 23/035; A63B 23/03516; A63B 23/03575; A63B 23/04; A63B 23/0405; A63B 23/0482; A63B 23/0494; A63B 23/12; A63B 23/1209; A63B 23/1245; A63B 23/1254; A63B 23/1263; A63B 23/1272; A63B 23/1281; A63B 26/00; A63B 26/003; A63B 2208/0214; A63B 2208/0219; A63B 2208/0242; A63B 2208/0247; A63B 2208/0257
See application file for complete search history.

(56) References Cited

U.S. PATENT DOCUMENTS

| | | | | | |
|---|---|---|---|---|---|
| 3,363,735 | A | * | 1/1968 | Hotchkiss | 193/37 |
| 3,645,379 | A | * | 2/1972 | Kornylak | 198/370.09 |
| 3,789,947 | A | * | 2/1974 | Blumrich | 180/6.48 |
| 4,339,126 | A | * | 7/1982 | Marletta | 482/132 |
| 4,715,460 | A | * | 12/1987 | Smith | 180/7.1 |
| 4,926,952 | A | * | 5/1990 | Farnam | 180/6.5 |
| D309,254 | S | * | 7/1990 | Guile | D8/375 |

(Continued)

*Primary Examiner* — Oren Ginsberg
*Assistant Examiner* — Gary D Urbiel Goldner
(74) *Attorney, Agent, or Firm* — Alan D. Kamrath; Kamrath IP Lawfirm, P.A.

(57) ABSTRACT

An exercise wheel includes two wheel assemblies rotatably mounted to two ends of an axle. Each wheel assembly is rotatable about a longitudinal axis. A plurality of first grooves and a plurality of second grooves are defined in an outer periphery of each wheel assembly. Each second groove is located between two adjacent first grooves. A first roller is rotatably mounted in each first groove of each wheel assembly. Each first roller is rotatable relative to a corresponding wheel assembly about a first rotating axis. A second roller is rotatably mounted in each second groove of each wheel assembly. Each second roller is rotatable relative to a corresponding wheel assembly about a second rotating axis. The second rotating axis of each second roller is parallel to and spaced from the longitudinal axis and is at a non-parallel angle to the first rotating axis of an adjacent first roller.

6 Claims, 8 Drawing Sheets

(56) References Cited

U.S. PATENT DOCUMENTS

| | | | | | |
|---|---|---|---|---|---|
| D318,791 | S * | 8/1991 | Guile | D8/375 |
| 5,064,045 | A * | 11/1991 | Leon | 193/35 MD |
| 5,213,176 | A * | 5/1993 | Oroku et al. | 180/168 |
| 5,404,984 | A * | 4/1995 | Hagman | 193/35 MD |
| 5,720,529 | A * | 2/1998 | Barron | 301/5.23 |
| 6,551,220 | B1 * | 4/2003 | Schroeder | 482/57 |
| 6,857,707 | B2 * | 2/2005 | Guile | 301/5.23 |
| 6,874,617 | B1 * | 4/2005 | Layne | 198/779 |
| 7,011,610 | B2 * | 3/2006 | Wawrzyniak | 482/106 |
| 7,566,102 | B2 * | 7/2009 | Guile | 301/5.23 |
| D676,214 | S * | 2/2013 | McKinnon et al. | D34/29 |
| 8,496,299 | B2 * | 7/2013 | Brudniok | 301/5.23 |
| 8,499,864 | B2 * | 8/2013 | Takenaka et al. | 180/7.1 |
| 8,821,357 | B2 * | 9/2014 | Reid | 482/108 |
| 9,073,399 | B1 * | 7/2015 | Richter | 1/1 |
| 2012/0157274 | A1 * | 6/2012 | MacColl et al. | 482/132 |
| 2013/0012369 | A1 * | 1/2013 | Prest | 482/132 |

* cited by examiner

EXERCISE WHEEL

BACKGROUND OF THE INVENTION

The present invention relates to an exercise wheel and, more particularly, to an exercise wheel for training various muscles of a body of a user.

A type of exercise wheel includes a handle and at least one wheel rotatably mounted around a central portion of the handle. In use, a user holds two ends of the exercise wheel with two hands, with the feet or knees on the ground. The user moves the hands forward beyond the head and uses the body strength to keep the body above the ground except the feet or the knees. Then, the user moves the hand backward. Repeated movement of this type can train the muscles of the abdomen, the hands, and the legs. However, the conventional exercise wheel can only rotate in a single direction, allowing limited gestures of the user. Furthermore, the exerciser wheel of this type requires a user with sufficient muscle strength to practice difficult postures. A user with insufficient muscle strength is unable to balance the body and is, thus, apt to fall to the ground.

Thus, a need exists for a novel exercise wheel allowing a user to proceed with different postures and allowing a user with insufficient muscle strength to practice difficult postures.

BRIEF SUMMARY OF THE INVENTION

The present invention solves this need and other problems in the field of easy operation and wider use of exercise wheels by providing an exercise wheel including an axle having two ends spaced from each other along a longitudinal axis of the axle and an intermediate section between the two ends. Two wheel assemblies are respectively and rotatably mounted to the ends of the axle. Each wheel assembly is rotatable about the longitudinal axis. Each wheel assembly includes an outer periphery surrounding the longitudinal axis. A plurality of first grooves is defined in the outer periphery of each wheel assembly and spaced from each other in a circumferential direction about the longitudinal axis. The intermediate section of the axle is located between the wheel assemblies. A plurality of second grooves is defined in the outer periphery of each wheel assembly. Each of the plurality of second grooves is located between two adjacent first grooves. A plurality of first rollers is respectively and rotatably mounted in the plurality of first grooves of each wheel assembly. Each of the plurality of first rollers is rotatable relative to a corresponding one of the wheel assemblies about a first rotating axis. A plurality of second rollers is respectively and rotatably mounted in the plurality of second grooves of each wheel assembly. Each of the plurality of second rollers is rotatable relative to a corresponding one of the wheel assemblies about a second rotating axis. The second rotating axis of each of the plurality of second rollers is parallel to and spaced from the longitudinal axis and is at a non-parallel angle to the first rotating axis of one of the plurality of first rollers adjacent thereto.

In an embodiment, the first rotating axis of each of the plurality of first rollers of each wheel assembly is orthogonal to the longitudinal axis.

In the embodiment, two first grooves are located between two adjacent second grooves.

In the embodiment, each of the plurality of first grooves includes two end faces spaced from each other in the circumferential direction. Each end face has a first pivotal hole. A first pin extends through each of the plurality of first rollers and has two ends respectively received in the first pivotal holes of the end faces of a corresponding one of the plurality of first grooves.

In the embodiment, each of the plurality of second grooves includes two lateral walls spaced from each other along a corresponding one of the second rotating axes. Each lateral wall has a second pivotal hole. A second pin extends through each of the plurality of second rollers and has two ends respectively received in the second pivotal holes of the lateral walls of a corresponding one of the plurality of second grooves.

In the embodiment, each wheel assembly includes first and second parts together forming a casing including the outer periphery having the plurality of first grooves and the plurality of second grooves. Each of the first and second parts includes an inner face and an outer face opposite to the inner face along the longitudinal axis. The inner faces of the first and second parts face each other. The outer periphery is defined between the outer faces of the first and second parts. Each of the plurality of first grooves has a first portion in the first part and a second portion in the second part. Each of the plurality of second grooves has a first portion in the first part and a second portion in the second part.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
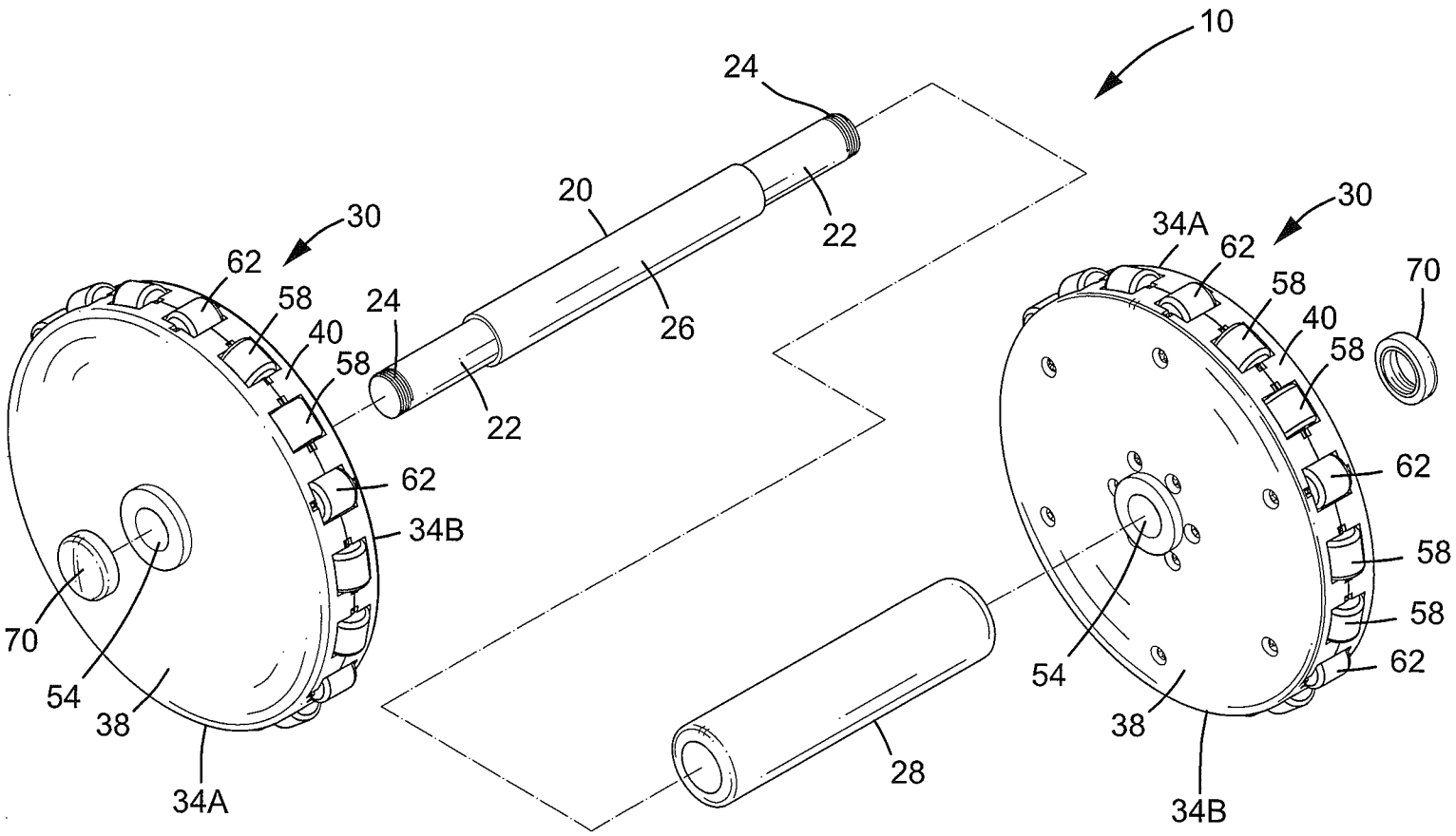
FIG. 1 is an exploded, perspective view of an exercise wheel according to the present invention.
Figure 2:
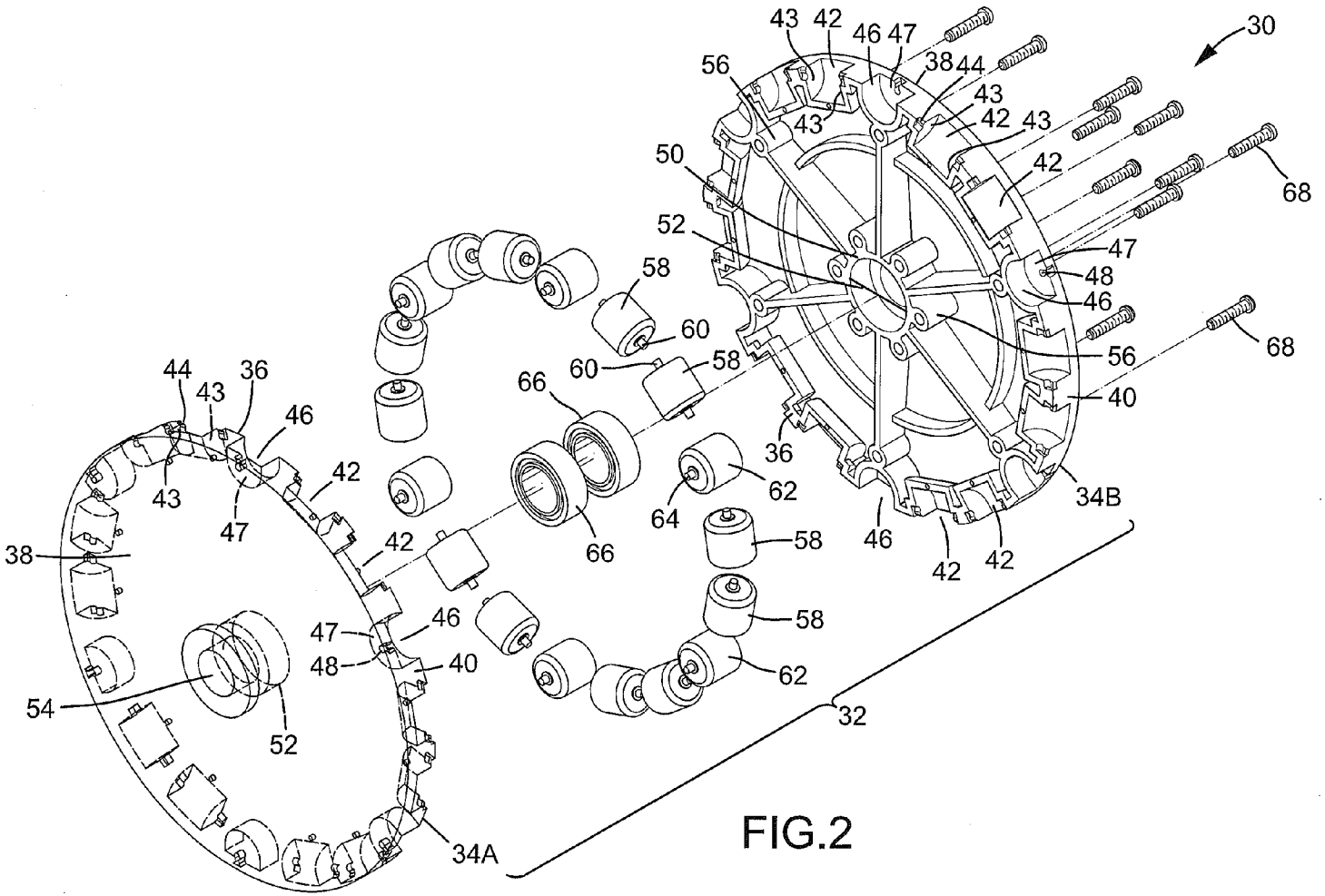
FIG. 2 is an exploded, perspective view of a wheel assembly of the exercise wheel of FIG. 1.
Figure 3:
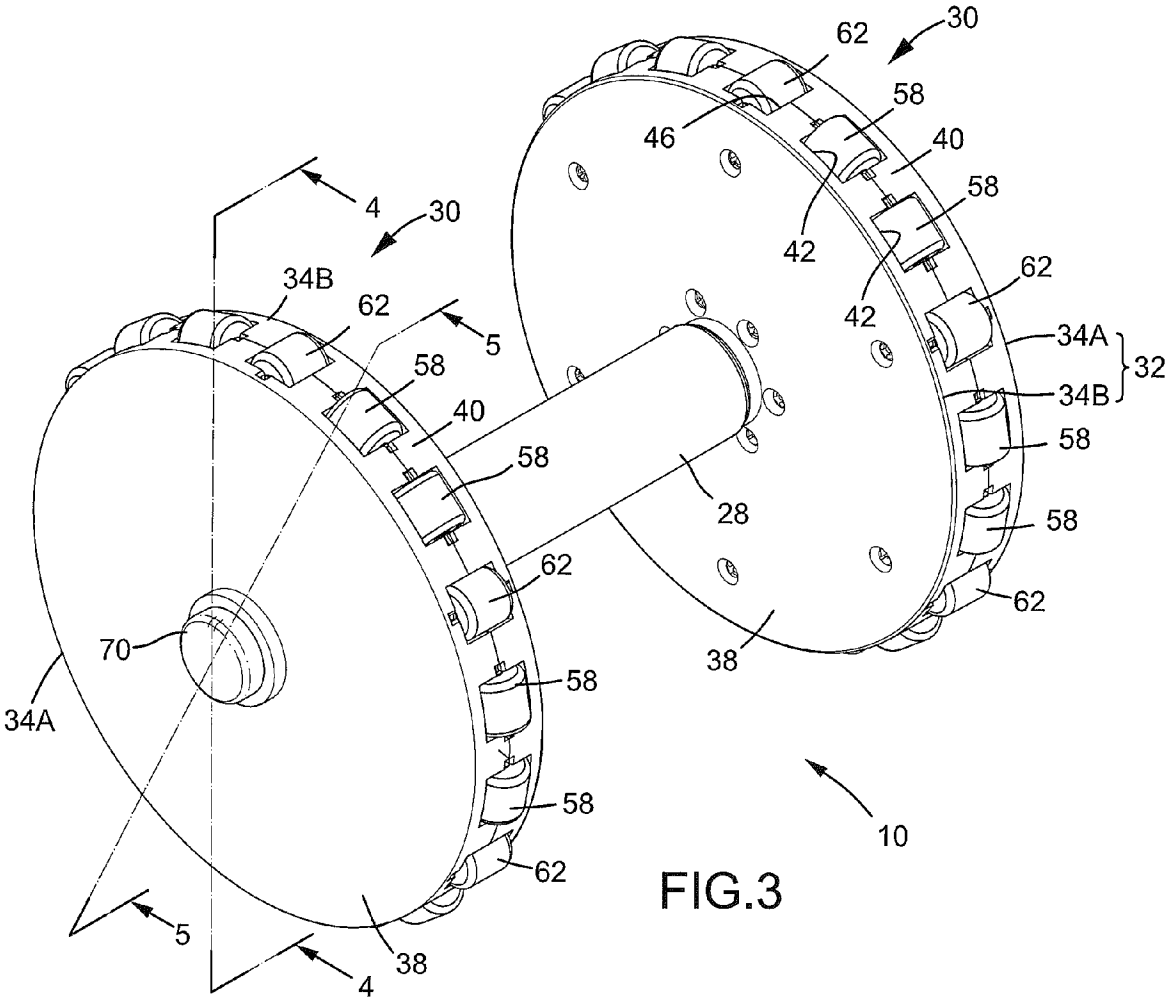
FIG. 3 is a perspective view of the exercise wheel of FIG. 1.
Figure 4:
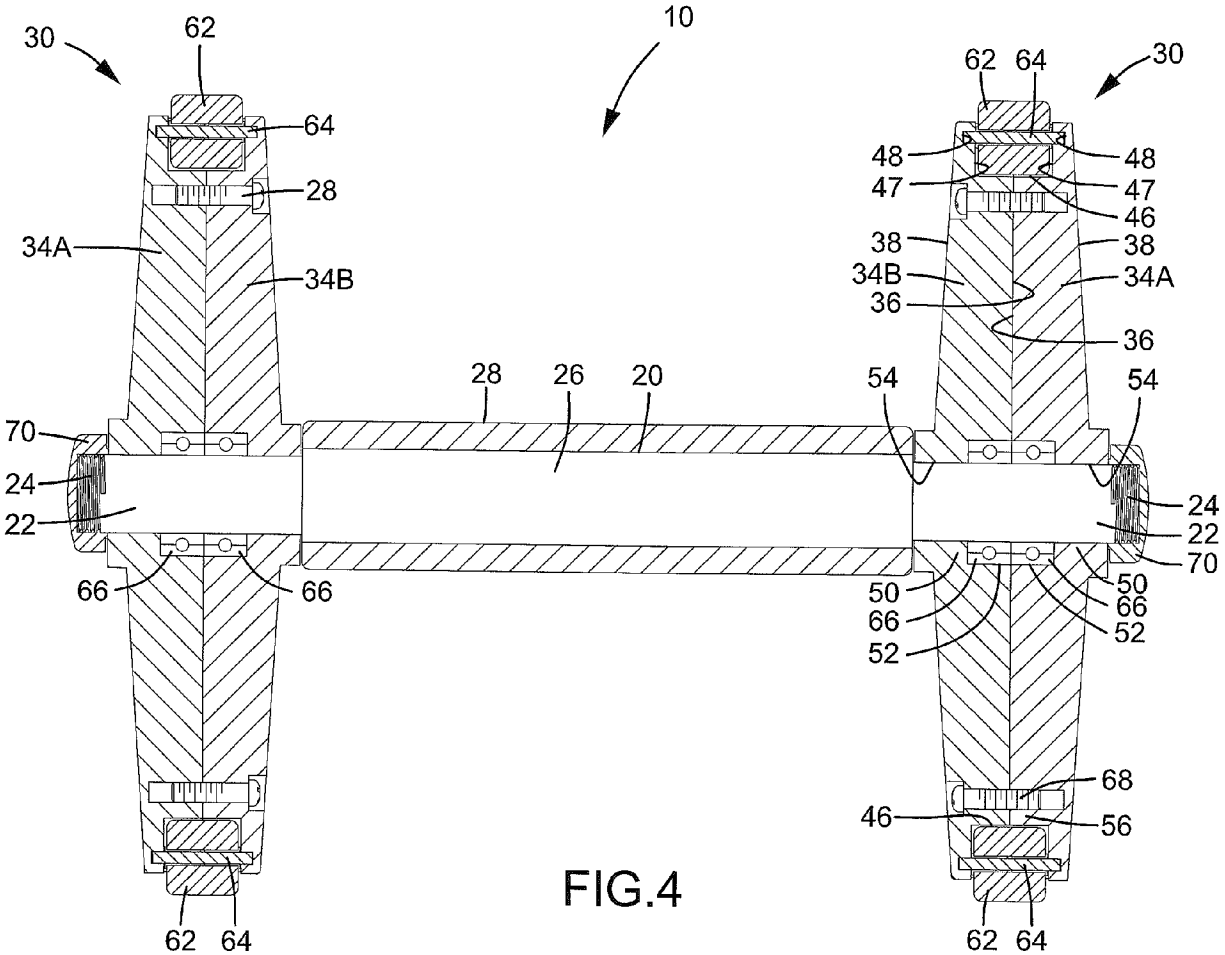
FIG. 4 is a cross sectional view taken along section plane 4-4 of FIG. 3.
Figure 5:
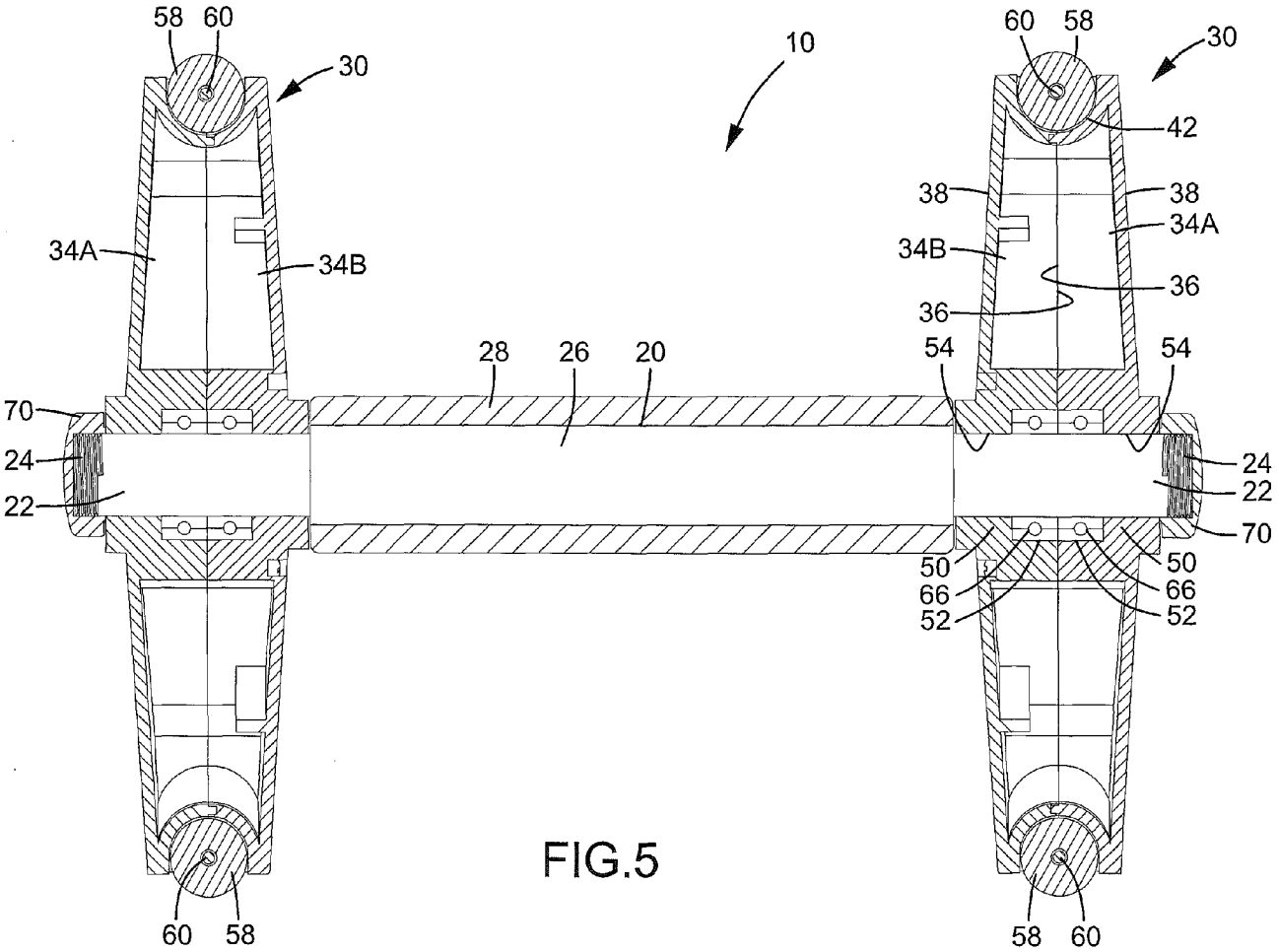
FIG. 5 is a cross sectional view taken along section plane 5-5 of FIG. 4.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms “first”, “second”, “upper”, “bottom”, “side”, “end”, “portion”, “section”, “longitudinal”, “width”, and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

An exercise wheel according to the present invention is shown in the drawings and generally designated 10. The exercise wheel 10 includes an axle 20 having two ends 22 spaced from each other along a longitudinal axis of the axle 20 and an intermediate section 26 between the two ends 22. The intermediate section 26 has a diameter larger than a diameter of each end 22. Each end 22 has an outer thread 24. A jacket 28 made of rubber or a similar material is mounted around the intermediate section 26 and can be held by a hand of a user.

According to the form shown, the exercise wheel 10 further includes the wheel assemblies 30 respectively and rotatably mounted to the ends 22 of the axle 20. Each wheel assembly 30 is rotatable about the longitudinal axis. The intermediate section 26 of the axle 20 is located between the wheel assemblies 30. Each wheel assembly 30 includes an axle hole 54 receiving one of the ends of the axle 20 and an outer periphery 40 surrounding the axle hole 54. The ends 22 of the axle 20 are respectively and rotatably coupled with the axle holes 54 of the wheel assemblies 30. A plurality of first grooves 42 is defined in the outer periphery 40 of each wheel assembly 30. The first grooves 42 are spaced from each other in a circumferential direction about the longitudinal axis. A plurality of second grooves 46 is defined in the outer periphery 40 of each wheel assembly 30. Each second groove 46 is located between two adjacent first grooves 42. Two first grooves 42 are located between two adjacent second grooves 46.

In the form shown, each wheel assembly 30 includes first and second parts 34A and 34B together forming a casing 32 including the outer periphery 40 having the first grooves 42 and the second grooves 46. Each of the first and second parts 34A and 34B includes an inner face 36 and an outer face 38 opposite to the inner face 36 along the longitudinal axis. The inner faces 36 of the first and second parts 34A and 34B face each other. The outer periphery 40 is defined between the outer faces 38 of the first and second parts 34A and 34B. Each first groove 42 has a first portion in the first part 34A and a second portion in the second part 34B. Each second groove 46 has a first portion in the first part 34A and a second portion in the second part 34B. Each of the first and second parts 34A and 34B further includes a central hub 50 defining a compartment 52, with the axle hole 54 extending from the outer face 38 through a bottom wall of the compartment 52. A bearing 66 having an inner diameter slightly smaller than a diameter of each axle hole 54 is mounted in the compartment 52 of each of the first and second parts 34A and 34B. Each end 22 of the axle 20 extends through the axle hole 54 of one of the first and second parts 34A and 34B into one of the bearings 66, with the outer thread 24 on each end 22 exposed outside of the corresponding wheel assembly 30. A fastener 70 is mounted to the outer thread 24 of each end 22 of the axle 20, limiting each wheel assembly 30 between the intermediate section 26 of the axle 20 and one of the fasteners 70. Each of the first and second parts 34A and 34B further includes a plurality of fixing portions 56 spaced from each other in the circumferential direction. Screws 68 extend through fixing portions 56 of the first and second parts 34A and 34B to secure the first and second parts 34A and 34B together.

A first roller 58 is rotatably mounted in each first groove 42 of each wheel assembly 30. Each first roller 58 is rotatable relative to a corresponding wheel assembly 30 about a first rotating axis. In the form shown, each first groove 42 includes two end faces 43 spaced from each other in the circumferential direction. Each end face 43 has a first pivotal hole 44. A first pin 60 extends through each first roller 58 and has two ends respectively received in the first pivotal holes 44 of the end faces 43 of a corresponding first groove 42.

A second roller 62 is rotatably mounted in each second groove 46 of each wheel assembly 30. Each second roller 62 is rotatable relative to a corresponding wheel assembly 30 about a second rotating axis. In the form shown, each second groove 46 includes two lateral walls 47 spaced from each other along a corresponding second rotating axis. Each lateral wall 47 has a second pivotal hole 48. A second pin 64 extends through each second roller 62 and has two ends respectively received in the second pivotal holes 48 of the lateral walls 47 of a corresponding second groove 46. The second rotating axis of each second roller 62 is parallel to and spaced from the longitudinal axis and is at a non-parallel angle to the first rotating axis of one of the first rollers 58 adjacent thereto. In the form shown, the first rotating axis of each first roller 58 of each wheel assembly 30 is orthogonal to the longitudinal axis.

Figure 6:
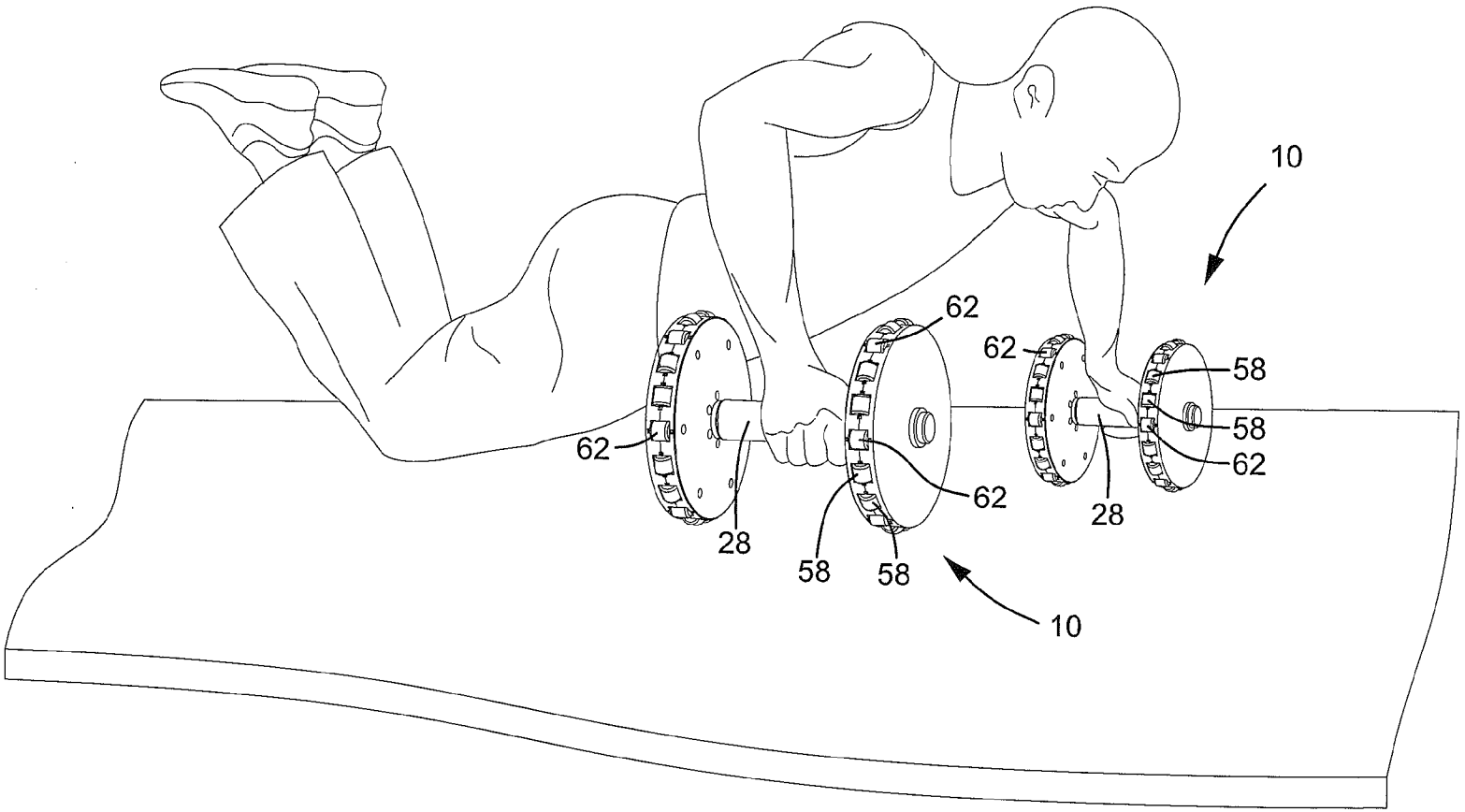
FIG. 6 is a schematic view illustrating a first type of use of the exercise wheel of FIG. 3.

FIG. 6 shows a first type of use of the exercise wheel 10. Specifically, each hand of the user holds an exercise wheel 10 with the axle 20 substantially parallel to the torso of the user. The face of the user faces the ground or a floor. The feet or the knee of the user are on the ground or the floor. Thus, the user can move the arms outward by rotating each wheel assembly 30 relative to the axle 20. The upper arms and the forearms are bent such that the face of the user moves toward the ground or the floor. Then, the user moves the arms toward the torso of the user, and the face moves away from the ground or the floor. The movements are repeated to exercise the muscles of the chest and the arms by using two exercise wheels 10.

Figure 7:
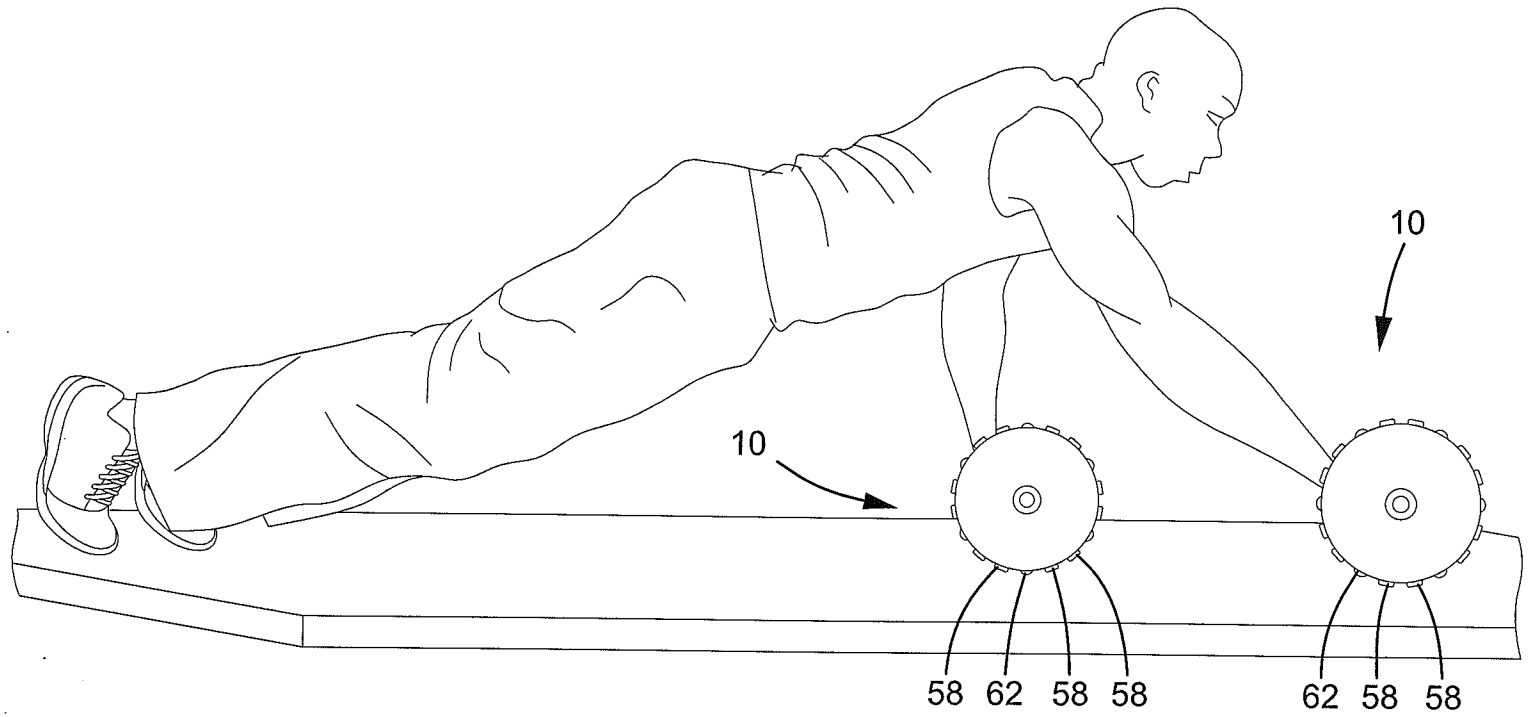
FIG. 7 is a schematic view illustrating a second type of use of the exercise wheel of FIG. 3.
Figure 8:
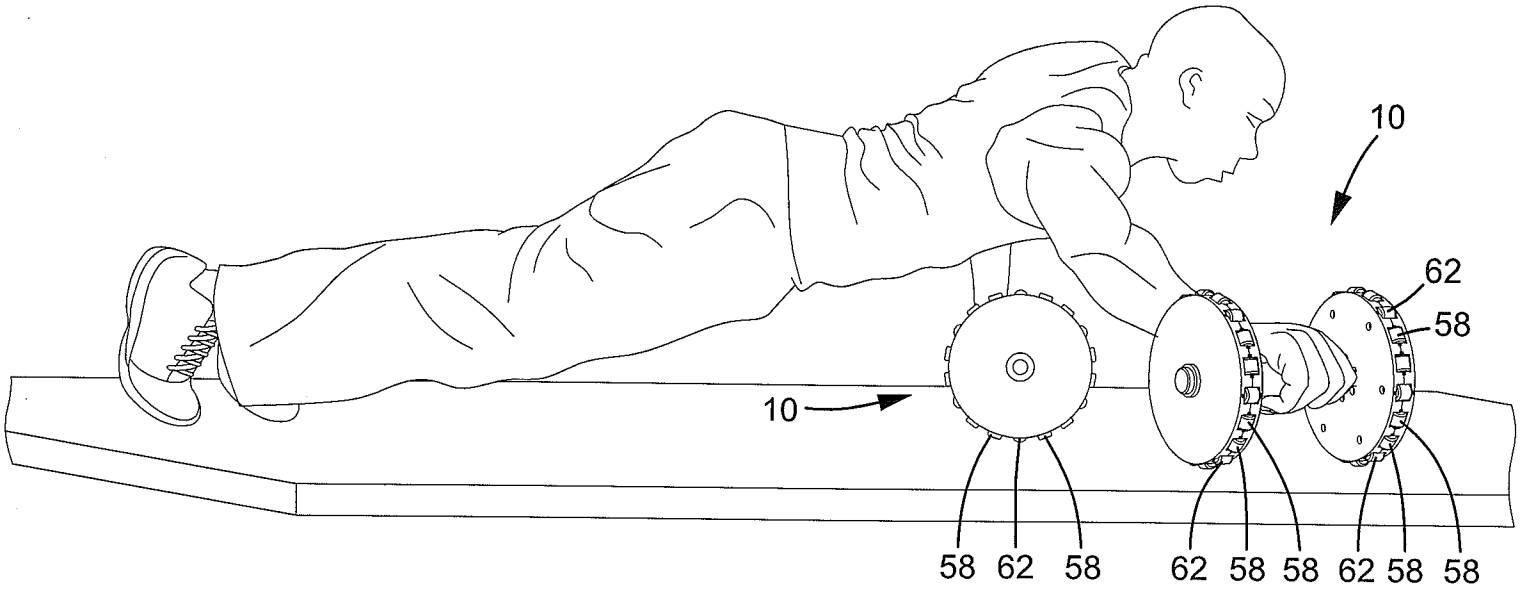
FIG. 8 is a schematic view illustrating movement of the second type of use of the exercise wheel of FIG. 3.

FIG. 7 shows a second type of use of the exercise wheel 10. Specifically, each hand of the user holds an exercise wheel 10 with the axle 20 substantially perpendicular to the torso. The feet are on the ground or the floor, and the face of the user faces the ground or the floor. The wheel assemblies 30 of an exercise wheel 10 can rotate relative to the corresponding axle 20 to move the exercise wheel 10 away from the head. Then, a force can be applied to the wheel assemblies 30 of the exercise wheel 10 away from the head in a direction parallel to the longitudinal axis of the corresponding axle 20 (FIG. 8) such that the first rollers 58 on the ground or the floor can roll. The muscles of the corresponding arm can sway in an arcuate path and move back to the original position. Thus, the muscles of the arm and the torso can be trained.

Note that each wheel assembly 30 of the exercise wheel 10 can rotate about the longitudinal axis of the axle 20, allowing the exercise wheel 10 to move in a first direction. Furthermore, each first roller 58 allows the exercise wheel 10 to move in a second direction. Thus, the exercise wheel 10 allows practice of more postures to provide different muscle trainings.

When each wheel assembly 30 rotates about the axle 20, a small resistance is generated on the wheel assembly 30 when a second roller 62 comes in contact with the ground or the floor. Furthermore, when the exercise wheel 10 moves along the longitudinal axis of the axle 20, the second roller 62 contacting the ground or the floor will generate a frictional force due to different rotating directions between the first and second rollers 58 and 62. Thus, the exercise wheel 10 is suitable for a beginner having insufficient muscle strength. The exercise wheel 10 can create a small resistance to reduce the need of balancing the body of the user by the muscles, reducing the risk of falling to the ground or the floor due to insufficient muscle strength of the beginner. As a result, the possibility of sport injury is reduced.

Now that the basic teachings have been explained, many extensions and variations will be obvious to one having ordinary skill in the art. For example, the casing 32 does not have to include the first and second parts 34A and 34B. Namely, the casing 32 can be integrally formed. Furthermore, each end face 43 of each first groove 42 can have a slit extending from the corresponding first pivotal hole 44 to the outer periphery 40 and having a width smaller than the diameter of the corresponding pivotal hole 44, and an end of a corresponding first pin 60 can pass the slit into the corresponding first pivotal hole 44. Likewise, each lateral wall 47 of each second groove 46 can have a slit extending from the corresponding second pivotal hole 48 to the outer periphery 40 and having a width smaller than the diameter of the corresponding second pivotal hole 48, and an end of a corresponding second pin 64 can pass the slit into the corresponding second pivotal hole 48. Furthermore, the exercise wheel 10 does not have to include the jacket 28, and the user can directly hold the intermediate section 26 of the axle 20.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. An exercise wheel comprising:

an axle including two ends spaced from each other along a longitudinal axis of the axle and an intermediate section between the two ends;

two wheel assemblies respectively and rotatably mounted to the two ends of the axle, with each of the two wheel assemblies rotatable about the longitudinal axis, with each of the two wheel assemblies including an outer periphery surrounding the longitudinal axis, with a plurality of first grooves defined in the outer periphery of each of the two wheel assemblies and spaced from each other in a circumferential direction about the longitudinal axis, with the intermediate section of the axle located between the two wheel assemblies, with a plurality of second grooves defined in the outer periphery of each of the two wheel assemblies, and with each of the plurality of second grooves located between two adjacent first grooves;

a plurality of first rollers respectively and rotatably mounted in the plurality of first grooves of each of the two wheel assemblies, with each of the plurality of first rollers rotatable relative to a corresponding one of the two wheel assemblies about a first rotating axis; and a plurality of second rollers respectively and rotatably mounted in the plurality of second grooves of each of the two wheel assemblies, with each of the plurality of second rollers rotatable relative to a corresponding one of the two wheel assemblies about a second rotating axis, and with the second rotating axis of each of the plurality of second rollers being parallel to and spaced from the longitudinal axis and being at a non-parallel angle to the first rotating axis of one of the plurality of first rollers adjacent thereto.

2. The exercise wheel as claimed in claim 1, with the first rotating axis of each of the plurality of first rollers of each of the two wheel assemblies being orthogonal to the longitudinal axis.

3. The exercise wheel as claimed in claim 1, with two first grooves located between two adjacent second grooves.

4. The exercise wheel as claimed in claim 3, with each of the plurality of first grooves including two end faces spaced from each other in the circumferential direction, with each of the two end faces having a first pivotal hole, and with a first pin extending through each of the plurality of first rollers and having two ends respectively received in the first pivotal holes of the two end faces of a corresponding one of the plurality of first grooves.

5. The exercise wheel as claimed in claim 4, with each of the plurality of second grooves including two lateral walls spaced from each other along a corresponding one of the second rotating axes, with each of the two lateral walls having a second pivotal hole, and with a second pin extending through each of the plurality of second rollers and having two ends respectively received in the second pivotal holes of the two lateral walls of a corresponding one of the plurality of second grooves.

6. The exercise wheel as claimed in claim 4, with each of the two wheel assemblies including first and second parts together forming a casing including the outer periphery having the plurality of first grooves and the plurality of second grooves, with each of the first and second parts including an inner face and an outer face opposite to the inner face along the longitudinal axis, with the inner faces of the first and second parts facing each other, with the outer periphery defined between the outer faces of the first and second parts, with each of the plurality of first grooves having a first portion in the first part and a second portion in the second part, and with each of the plurality of second grooves having a first portion in the first part and a second portion in the second part.

* * * * *